US006568019B2

(12) United States Patent
Markelz

(10) Patent No.: US 6,568,019 B2
(45) Date of Patent: May 27, 2003

(54) MECHANICAL BRIDGE ASSEMBLY AND METHOD

(76) Inventor: Paul H. Markelz, 28W 231 Oak Creek Dr., West Chicago, IL (US) 60185

( * ) Notice: Subject to any disclaimer, the term of this patent is extended or adjusted under 35 U.S.C. 154(b) by 33 days.

(21) Appl. No.: 09/865,223

(22) Filed: May 25, 2001

(65) Prior Publication Data

US 2002/0174495 A1 Nov. 28, 2002

(51) Int. Cl.[7] ..... G01D 15/10
(52) U.S. Cl. ..... 14/43
(58) Field of Search ..... 14/31, 43, 62, 14/66

(56) References Cited

U.S. PATENT DOCUMENTS

| | | | | | |
|---|---|---|---|---|---|
| 94,529 | A | * | 9/1869 | Trowbridge | 14/43 |
| 514,754 | A | * | 2/1894 | Jessup | 14/43 |
| 535,831 | A | * | 3/1895 | Jessup | 14/43 |
| 598,012 | A | * | 1/1898 | Sampson | 14/47 |
| 617,201 | A | * | 1/1899 | Strobel | 14/43 |
| 663,484 | A | * | 12/1900 | Bevans | 14/43 |
| 1,619,678 | A | * | 3/1927 | Prinz | 14/43 |
| 3,668,729 | A | * | 6/1972 | Mori et al. | 14/43 |
| 4,907,312 | A | * | 3/1990 | Yang et al. | 14/21 |

FOREIGN PATENT DOCUMENTS

FR 2750146 * 12/1997

* cited by examiner

*Primary Examiner*—Gary S. Hartmann
(74) *Attorney, Agent, or Firm*—Quarles & Brady, LLP

(57) ABSTRACT

An apparatus for opening a mechanical bridge. The apparatus includes at least two adjacent bridge spans where the first of the bridge spans is removable from its initial position and the second of the bridge spans is at least partially movable into the space originally occupied by the first span so that at least a portion of the second bridge span can be separated from yet a third adjacent span. This forms an opening between the second and third spans. Alternatively, a span can be moved laterally and then longitudinally to open a section of the bridge.

21 Claims, 14 Drawing Sheets

MECHANICAL BRIDGE ASSEMBLY AND METHOD

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The field of the invention is mechanical bridges and more specifically bridges including spans that are openable.

Bridges are required to facilitate convenient rail and vehicular traffic over rivers, streams, dams and the like (hereinafter collectively referred to as rivers). While bridges are necessary, unfortunately bridges can impede passage of vessels along rivers there below. In order to accommodate both rail and vehicular traffic over rivers and travel along the rivers by ships, barges, etc, bridge designers have developed several different mechanical type bridges including one or more bridge spans that can open and close.

One mechanical bridge type is generally referred to as a vertical-lift bridge. A vertical-lift bridge typically includes vertical towers at either end of a bridge span. When positioned for vehicular traffic, the span is in a low position where a top surface is aligned with top surfaces of adjacent bridge spans. To accommodate travel below the bridge span the span can be raised between the towers.

While vertical-lift bridges can accommodate both river and vehicular travel, these bridges have several shortcomings. First, vertical-lift bridges, while accommodating some river travel, still restrict travel as the lifted span remains above the area through which travel occurs. Second, the motors and other mechanical equipment required to lift the bridge span are relatively large and therefore expensive. In addition, because of the mechanics involved with vertical-lift bridges, maintenance costs for vertical lift bridges are relatively high.

Another mechanical bridge type is a swing span bridge. A typical swing span bridge includes a moveable span that pivots about a vertical axis to provide required opening clearance for navigation traffic. Swing spans are typically symmetrical with equal length cantilevers to each side of the vertical axis. Some swing span bridges, however, are configured with unsymmetrical cantilevers that are counterweighted to balance the bridge. Swing span bridges are advantageous as they provide unlimited vertical clearance for river bound traffic when the span is open.

Unfortunately swing spans also have several shortcomings. First, when a swing span is horizontally pivoted into the open position the span ends are generally considered to be navigational hazards. The span ends are directed against movement of water bound traffic and therefore are prone to vessel collision. Thus, often substantial fender systems are required to protect the span and vessels in the area. Second, swing spans typically require twice as much moveable length span as other mechanical span designs to provide the same opening width. This is because, as indicated above, most swing span bridges require equal length span segments cantilevered about the vertical pivot point. Third, the mechanical components required to manipulate the large span sections are generally relatively large and therefore relatively expensive.

Yet one other mechanical bridge type is referred to generally as a bascule type bridge. A typical bascule bridge includes a leaf that pivots about a horizontal axis to provide a required opening and clearance for river bound traffic. Counterweights are usually provided to balance the weight of the span and minimize the operating requirements on the drive machinery. The bascule span bridges provide unlimited vertical clearance when open.

Bascule bridges, like the other bridge types described above, have several shortcomings. First, the counterweight required to balance the bascule span is typically rather large. As most mechanical bridges are relatively low to the water, the counterweights are typically positioned above a span adjacent the moveable span. To support the counterweight these bridge types often require large and expensive overhead framing systems and massive foundations below the spans to handle the overturning moments that occur. Second, the mechanics required to control a bascule bridge are extremely complex and therefore expensive. Third, bascule bridges requiring massive counterweights are relatively unsafe in certain geographic areas that are subject to seismic tremors.

Thus, there is a need for a mechanical bridge that is simple, relatively inexpensive, provides unlimited vertical clearance and that does not require massive overhead or counterweight components.

BRIEF SUMMARY OF THE INVENTION

It has been recognized that a relatively simple bridge design can overcome many of the shortcomings of the prior art bridges described above. To this end, by moving a bridge span essentially within a single vertical plane from a supporting position into a storage position, system mechanics can be greatly simplified without sacrificing safety. To this end, in one embodiment, an openable span is moved laterally from a supporting position and then longitudinally along the side of an adjacent span to open a space for water bound traffic. In another embodiment an adjacent span is removed from its position adjacent an openable span and then the openable span is moved at least in part into the adjacent position to open a space for water bound traffic.

Thus, one object of the invention is to provide a simplified openable bridge design. This object is accomplished by minimizing required vertical span movement. In some embodiments there is no vertical span movement while in other embodiments vertical movement is limited in several ways. First, the vertical distance of movement is minimized. Second the size of the span that has to be moved is limited. To this end, when a first span is vertically moved and then a second span is horizontally moved into the space originally occupied by the first span, the first span is only half as large as the second span and hence a minimally sized span is vertically moved.

Another object is to provide a relatively safe mechanical bridge. To this end, because vertical span movement is limited, above deck structure is minimized. Because above deck structure is minimized bridges constructed according to the present teachings are relatively safe in various environments including those that may be subject to periodic earth quakes and other disruptive natural phenomenon.

Yet one other object is to provide a relatively inexpensive bridge system. Because most span movement is horizontal relatively small motors can be used to move spans on rollers as opposed to lifting the spans.

One other object is to provide a bridge where, when a span is open, the open space can accommodate passage of any vessel there below. To this end the present design has no components that remain above the open space after a span is moved.

Consistent with the above objects and advantages, the present invention includes a bridge assembly comprising first, second and third adjacent piers, the first and second piers defining a first space there between and the second and third piers defining a second space there between, third and fourth spaces above the first and second spaces, respectively, a first bridge span positionable so as to traverse the distance between the first and second piers within the third space, a second bridge span positionable so as to traverse the distance between the second and third piers within the fourth space, a first motivator linked to the first bridge span for moving the first span into and out of the third space and a second motivator linked to the second bridge span for moving at least a portion of the second bridge span from the fourth space to the third space so that at least a portion of the fourth space is unobstructed.

In some embodiments the invention further includes at least one intermediate pier between the second and third piers, the space between the intermediate and third piers being a fifth space, the space above the fifth space being an openable space, the openable space being the portion of the fourth space that is unobstructed when the portion of the second bridge span is moved to the third space. In some cases the first, second, third and intermediate piers are essentially equi-spaced.

In some embodiments roller members are provided between the tops of the piers and the spans thereabove. The rollers may be mounted to the tops of the piers.

In several embodiments the first span has a span width, each of the first and second piers has a pier width that is substantially twice as wide as the span width, first and second in-line sections of the first and second piers, respectively, aligned with the third pier and defining an in-line space, a supporting space above the in-line space, first and second lateral sections of the first and second piers laterally adjacent the first and second in-line sections, respectively, the lateral sections defining a lateral space there between, a receiving space above the lateral space, the first motivator for moving the first span between the supporting space and the receiving space.

In some embodiments the first and second in-line sections and first and second lateral sections comprise one lateral load bearing element and the first span comprises another lateral load bearing element and the assembly further includes a first track mounted to a first one of the lateral load bearing elements and rollers mounted to the second of the lateral load bearing elements, the rollers supportable on the track to facilitate rolling of the first span between the supporting and receiving spaces. Here, the track may be secured to the first span and the rollers may be secured to the tops of the piers.

The assembly may further include an intermediate pier between the second and third piers wherein the second and intermediate piers comprise a longitudinal load bearing element and the second span comprises another longitudinal load bearing element and, wherein, the assembly further includes a second track mounted to a first one of the longitudinal load bearing elements and rollers mounted to the second of the longitudinal load bearing elements, the rollers supportable on the track to facilitate rolling of the second span such that the at least one section moves between the fourth space and the supporting space. The longitudinal load bearing element that includes the second and fourth piers may also includes the first pier.

In some embodiments the first motivator moves the first span between the third space and a space above the third space. In other embodiments the first motivator moves the first span between the third space and the first space.

The second span may include first and second ends, a top and a bottom, the second end adjacent the third pier when the second span is in the fourth space, the assembly further including first and second aligning apparatus at the second end and the top of the third pier, respectively, the second aligning apparatus receiving the first aligning apparatus when the second span is moved into the fourth space so as to align the second span with the third pier. The first aligning apparatus may include a first inclined surface. Similarly, the second aligning apparatus may include a second inclined surface. In addition, the second aligning apparatus may include a guiding roller.

Another embodiment of the invention includes a method for opening a section of a bridge where the bridge includes several spans that are longitudinally arranged along the length of the bridge including at least first and second adjacent spans that, when the bridge is closed, occupy first and second spaces, respectively, the method comprising the steps of moving the first bridge span from the first space, moving at least a segment of the second bridge span from the second space into the first space so that at least a portion of the second space is unobstructed.

According to one embodiment, when the first span is in the first space and the second span is in the second space the first and second spans are aligned longitudinally and, the step of moving the first bridge span includes moving the first span from the first space laterally and wherein the step of moving the second span includes moving the second span longitudinally. In another embodiment, the step of moving the first bridge span includes moving the first span upward and out of the first space.

In yet another embodiment the invention includes a bridge assembly comprising first, second and third adjacent piers, each of the second and third piers including an in-line section and an adjacent lateral section, the in-line sections aligned along a longitudinal axis and the lateral sections aligned along a lateral axis that is essentially parallel to the longitudinal axis, the first pier and second pier in-line section defining a first in-line space there between, the second and third pier in-line sections defining a second in-line space there between, a space adjacent the first in-line space and the second lateral section defining a first lateral space, the second and third lateral sections defining a second lateral space there between, third and fourth in-line spaces above the first and second in-line spaces, respectively, and third and fourth lateral spaces above the first and second lateral spaces, respectively, a first bridge span positioned so as to traverse the distance between the first and second piers within the third in-line space, a second bridge span positionable so as to traverse the distance between the second and third piers within the fourth in-line space, a first motivator linkable to the second bridge span for moving the second span between the fourth in-line space and the fourth lateral space and a second motivator linkable to the second bridge span for moving at least a portion of the second bridge span from the fourth lateral space to the third lateral space so that at least a portion of the fourth lateral space is unobstructed.

Here the assembly may further include at least one intermediate pier between the second and third lateral pier sections, the space between the intermediate and third lateral section being a fifth space, the space above the fifth space being an openable space, the openable space being the portion of the fourth lateral space that is unobstructed when the portion of the second bridge span is moved to the third lateral space. The first lateral section, second lateral section, third lateral section and intermediate pier may be essentially equi-spaced.

The invention further includes a method for opening a section of a bridge where the bridge includes at least first and second adjacent spans that are longitudinally alignable along the length of the bridge and are supported by at least first, second and third piers, each pier including an in-line section and a lateral section laterally positioned with respect to the in-line section, the space between the first and second in-line pier sections being a first in-line space, the space between the second and third in-line pier sections being a second in-line space, the space above the first and second in-line spaces being a third in-line space and the space above the second in-line space being a fourth in-line space, the space between the first and second lateral pier sections being a first lateral space, the space between the second and third lateral pier sections being a second lateral space, the space above the first lateral space being a third lateral space and the space above the second lateral space being a fourth lateral space, when the bridge is closed, the first and second spans occupying the third and fourth in-line spaces, respectively, the method comprising the steps of: moving the second bridge span laterally from the fourth in-line space to the fourth lateral space and moving at least a segment of the second bridge span from the fourth lateral space into the third lateral space so that at least a portion of the fourth space and a portion of the fourth lateral space are unobstructed.

These and other objects, advantages and aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefor, to the claims herein for interpreting the scope of the invention.

DETAILED DESCRIPTION OF THE INVENTION

Figure 1A:
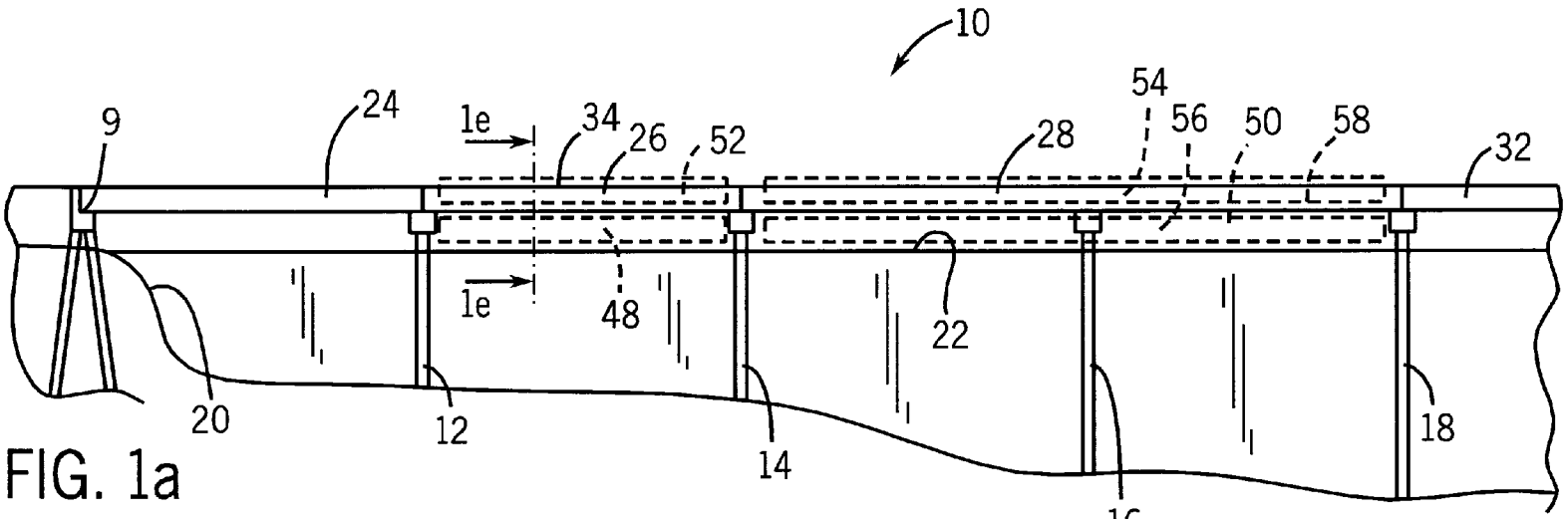
FIGS. 1*a* through 1*d* are schematic diagrams illustrating a first embodiment to the present invention.

Referring now to the drawings wherein like reference numerals represent similar elements throughout the several views and, more specifically, referring to FIGS. 1*a* through 1*d,* a first embodiment of the present invention will be described in the context of a mechanical bridge 10 including a plurality of piers 9, 12, 14, 16 and 18 (only five illustrated) that begins at a first shore 20 and traverses over a river 22 to a shore (not illustrated) opposite shore 20. Piers 9, 12, 14, 16 and 18 are equi-spaced so as to equally accept load from traffic passing across the bridge thereabove. In addition to piers 9, 12, 14, 16 and 18, bridge 10 also includes a plurality of spans or bridge sections 24, 26, 28 and 32 that traverse the distance between the tops of piers 9, 12, 14, 16 and 18 and provide a deck 34 above river 22 for vehicular travel. Spans 24, 26 and 32 have essentially identical lengths and traverse the distance between the tops of two adjacent piers. For example, span 26 traverses the distance between the tops of piers 12 and 14. One special and relatively long span 28 traverses the distance between the tops of three adjacent piers including piers 14, 16 and 18. Thus, span 28 is twice as long as any of the other spans in bridge configuration 10.

Figure 1B:
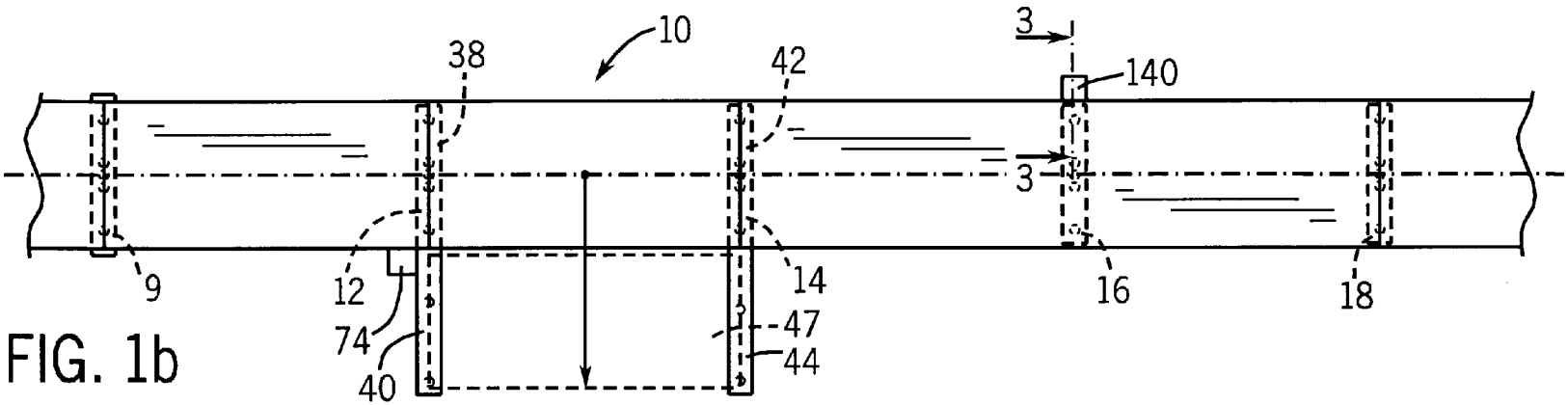

Referring specifically to FIG. 1*b,* piers 12 and 14 are approximately twice as wide as the other piers that make up bridge 10. To this end, pier 12 includes an in-line section 38 that is, as the name implies, in-line with other piers (e.g., 16, 18, etc.) that form the bridge and a lateral section 40 that is laterally positioned with respect to in-line section 38. Similarly, pier 14 includes an in-line section 42 and a lateral section 44. Lateral sections 40 and 44 are aligned to the same side of the in-line sections 38 and 42 and are capable of supporting a bridge span thereabove.

For the purpose of explaining this first embodiment of the invention it is advantageous to define the illustrated piers in a specific manner and also to define various spaces with respect to those piers. To this end, referring still to FIGS. 1*a* through 1*d* and also to FIG. 1*e,* piers 12, 14 and 18 will generally be referred to as first, second and third piers, pier 16 will be referred to as an intermediate pier, the space 48 between piers 12 and 14 will be referred to as a first space, the space 50 between piers 14 and 18 will be referred to as a second space, the space above first space 48 and, in FIG. 1*a* occupied by span 26, will be referred to as a third space 52, the space above second space 50 and, in FIG. 1*a,* occupied by span 28, will be referred to as a fourth space 54, the space between in-line pier sections 38 and 42 will be referred to as an in-line space 41, the space above in-line space 41 will be referred to as a supporting space 43, the space between lateral pier sections 40 and 44 will be referred to as a lateral space 45 and the space above lateral space 45 will be referred to as a storage space 47. In addition, end 64 of span 28 will be referred to as a leading end 64. In addition, the space between piers 16 and 18 will be referred to as a fifth space 56 and the space thereabove which in FIG. 1*a* is occupied by a portion of span 28 will be referred to as an opening space 58.

Figure 1C:
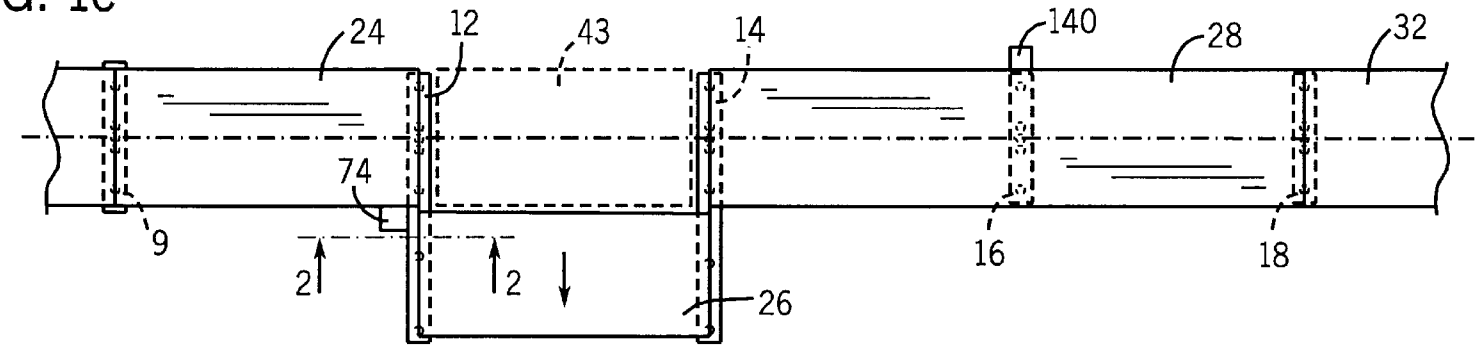
Figure 1D:
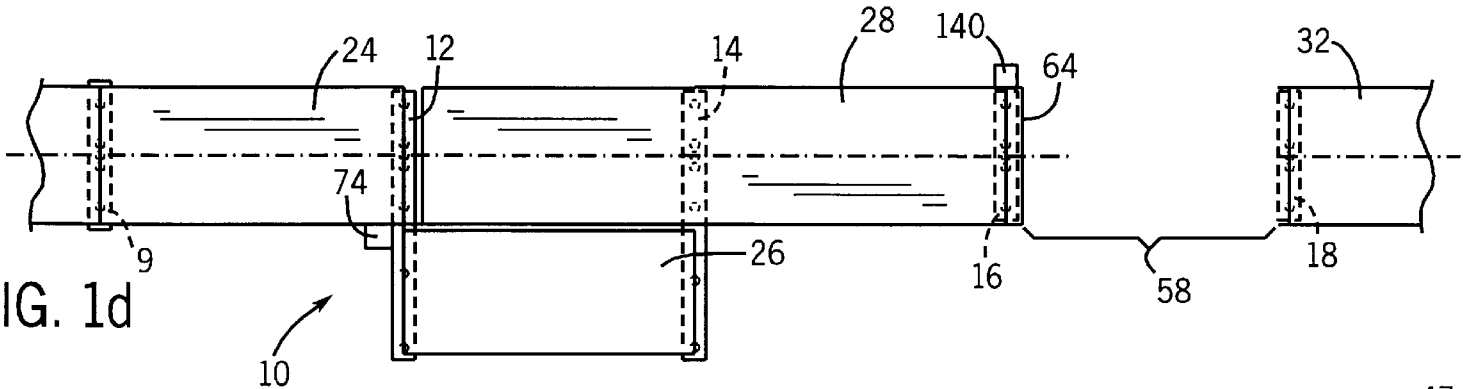
Figure 1E:
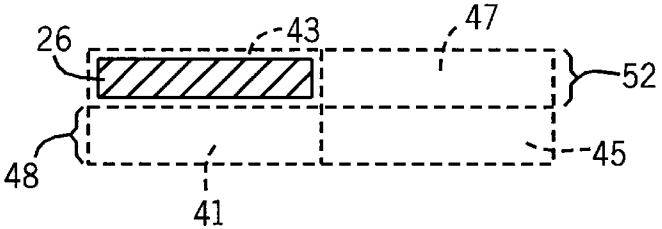

With the spaces and piers as defined above and referring to FIGS. 1*a* through 1*e,* according to this first embodiment of the invention, a section of bridge 10 can be opened to allow river bound traffic to pass through the open section. To this end, according to a first step in the process of clearing a passage through bridge 10 for river bound traffic, first span 26 is removed from supporting space 43. This is accomplished by moving first span 26 laterally from supporting space 43 to storage space 47 so that lateral sections 40 and 44 of piers 12 and 14, respectively, support span 26. This condition is illustrated in FIG. 1*c*.

Next, second span 28 is moved longitudinally along the tops of the in-line piers and pier sections so that at least a portion of span 28 is positioned within supporting space 43. When span 28 is moved in this manner, an opening is created between spans 28 and 32. By moving span 28 as far as possible into supporting space 43 so that approximately half of span 28 is within space 52, the entire opening space 58 is rendered unobstructed so that river bound traffic can pass therethrough.

To close the bridge 10, the above described process is simply reversed. To this end, a first step in closing the open space 58 is to drive span 28 toward span 32 until leading end 64 of span 28 is received and supported on the top of pier 18. Next, span 26 can be moved form it's lateral position illustrated in FIG. 1*d* to its in-line position as illustrated in FIG. 1*b* where span 26 traverses the distance between and is support by adjacent in-line pier sections 38 and 42.

Figure 2:
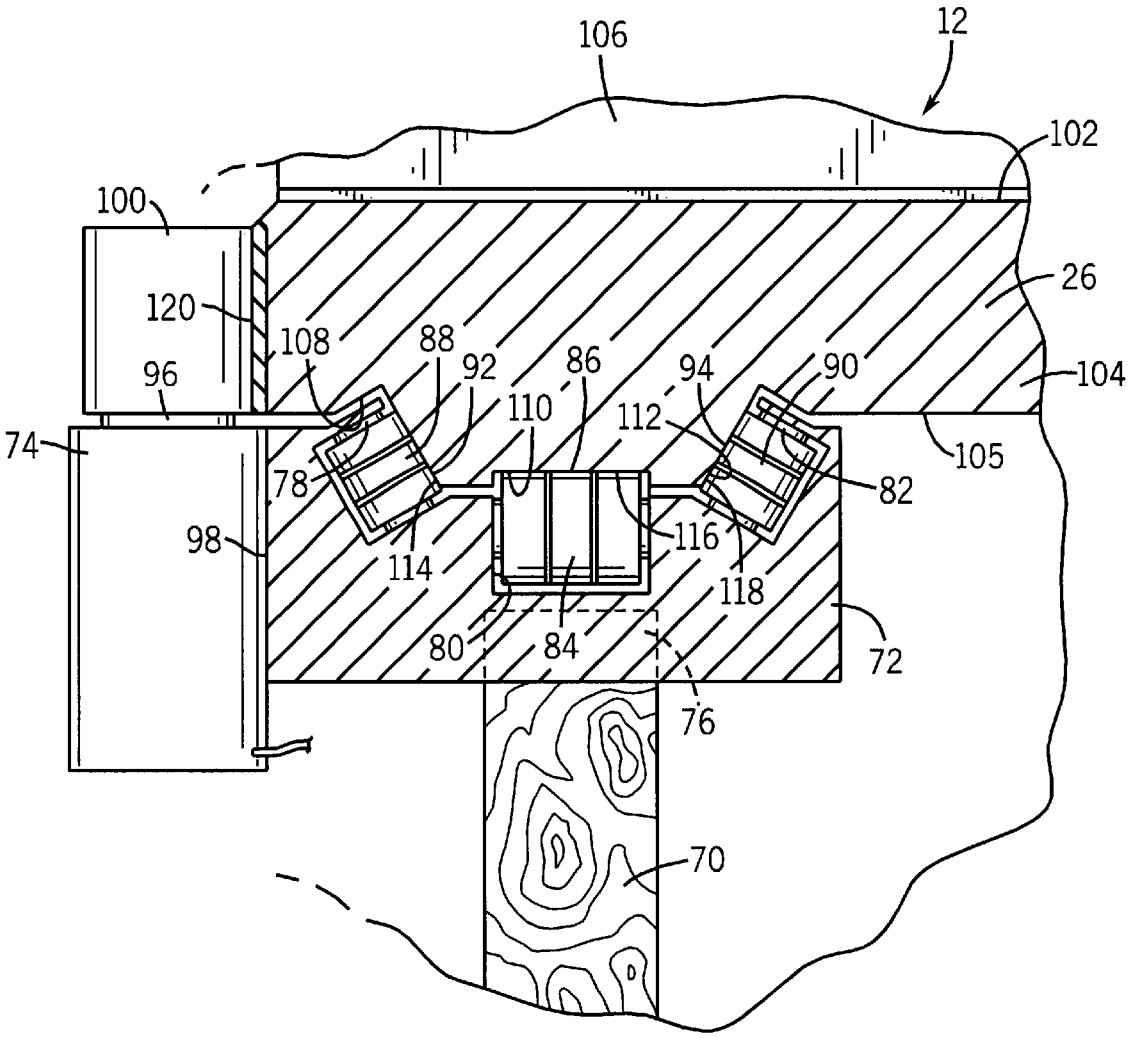
FIG. 2 is a cross-sectional view taken along the line 2—2 of FIG. 1*c;*

Referring now to FIGS. 1*b* and 2, the mechanism used to slide or move span 26 from the supporting space 43 to the storage space 47 will be described in more detail. To this end, the tops of piers 12 and 14 comprise a first lateral load bearing element while the underside of span 26 comprises a second lateral load bearing element. Rollers are provided on one of the lateral load bearing elements while one or more tracks are provided on the other of the lateral load bearing elements. The rollers and tracks cooperate to facilitate lateral movement of span 26. Similarly, the tops of piers 14 and 16 comprise a first longitudinal load bearing element and the underside of span 28 comprises a second longitudinal load bearing element. Rollers are provided on one of the longitudinal load bearing elements while one or more tracks are provided on the other of the longitudinal load bearing elements. The rollers and tracks on the longitudinal elements cooperate to facilitate longitudinal movement of span 28. Specifically, at the tops of each pier 12 and 14, rollers are provided that facilitate easy movement of span 26 between the supporting space 43 and the storage space 47. The rollers in this embodiment are identical at the tops of piers 12 and 14 and therefore, only the rollers corresponding to the top of pier 12 will be described in detail. The configuration at the top of pier 12 includes a timber 70, a pier cap 72, a first motivator 74 and the first span 26. Timber 70 includes a lower end (not illustrated) that extends down through the river (see 14 in FIG. 1*a*) and is embedded in the bottom of the river and a top end 76. Pier cap 72 is a concrete member and is formed about the top end 76 of timber 70. Although not illustrated in FIG. 2, a plurality of timbers adjacent timber 70 are provided that support cap 72 and the other bridge components thereabove.

Cap 72 forms three roller housings 78, 80 and 82 that generally face upward. A central roller housing 80 includes a plurality of rollers 84 that form an upward facing roller surface 86 for supporting span 26 thereabove. Lateral roller housings 78 and 82 each support a plurality of rollers 88, 90, respectively, that form support surfaces 92 and 94 for guiding and supporting span 26 thereabove.

Surfaces 92 and 94 are tilted in a direction toward central roller housing 80 and therefore restrict movement of span 26 in other than the direction between supporting space 43 and storage space 47.

Motivator 74 is a motor and is securely mounted to a side 98 of cap 72 (see also FIGS. 1*b* through 1*d* in this regard). Motor 74 includes a shaft 96 that extends up above cap 72. At the distal end of shaft 96 a large gear having vertically aligned teeth is mounted.

Span 26 includes a bottom support 104 and various components that form a top support 106 that will be described in more detail below. Bottom support 104 is preferably formed of concrete and has a top surface 102 and a bottom surface 105. Top surface 102 is essentially flat and provides a support deck for components 106 thereabove. Bottom surface 106 forms three separate roller recesses 108, 110 and 112 that form roller surfaces 114, 116 and 118, respectively. A central roller surface 116 faces downward and is sized so as to receive surface 86 of rollers 84 thereon. Similarly, roller surfaces 114 and 118 are sized and configured so as to receive rollers 88 and 90, respectively, corresponding to the lateral rollers as illustrated.

A lateral edge 120 of span 26 forms a gear receiving surface having teeth sized to receive the teeth of gear 100. Edge 120 extends so that the teeth of gear 100 are received within the teeth of edge 120. While structure 104 is illustrated and described above as being formed of concrete, it should be appreciated that certain of the features may be formed of other more suitable materials used for specialized purpose. For instance, a steel member may be mounted to member 104 that forms the teeth 120 that cooperate with motor 74 to move span 26. Similarly, flat steel plates may be provided on the surfaces of each of roller surfaces 114, 116 and 118 that may be greased to facilitate easy movement of rollers there along.

While only a single roller system is illustrated in FIG. 2, it should be appreciated that several roller systems like the one illustrated in FIG. 2 may be provided at the top each of the first and second piers 12, 14, respectively. For instance, in one embodiment at least four roller assemblies would be equi-spaced along the top of each of piers 12 and 14. It should also be appreciated that, because efficient roller systems reduce the amount of power required to move large objects, a relatively small motor 74 should be able to move a span 26 back and forth between the supporting space 43 and storage space 47. To this end, to move span 26, motor 74 is driven and applies a force to span 26 that drives the span 26 either into or out of the figure illustrated in FIG. 2 and therefore either toward or away from supporting space 43 (see also FIGS. 1*c* and 1*e*).

While first span 26 remains fully supported during movement between supporting space 43 and storage space 47, as illustrated in the FIG. 1 sequence of drawings, second span 28 is not fully supported during movement between spans 12 and 18. In other words, span 28, at certain times during movement, is cantilevered about one or more piers so that at least segments of span 28 are out and over open spaces therebelow. For this reason, a relatively more complex roller system is contemplated to maintain span 28 in a stable configuration during movement. Referring now to FIGS. 1*a* through 1*d* and also to FIG. 3, the components that are used to construct the top of pier 16 are illustrated. The components in FIG. 3 include two timbers 130, 132, a pier cap 134, a span lower structure 136, a span upper structure 138 and a second motivator 140. Timbers 130 and 132 both extend down to the bottom of the river bed to provide support. The top ends 142 and 144 of timbers 130 and 132, respectively, extend into a lower surface of cap 134. Cap 134 forms a plurality of roller housings that together cooperate to provide support span 16 and also to provide guidance to span 16 as span 16 is moved. Four roller housings are illustrated including housings 146, 148, 150 and 152. A plurality of rollers 154 are mounted in housing 150 and form a support surface 156 that faces upward. Similarly, a plurality of rollers 158 are mounted in housing 152 and form a support surface 160 that faces upward. A plurality of rollers 162 are mounted in housing 148 and form a vertical guiding surface 164. A plurality of rollers 166 are mounted in housing 146 and provide a downward facing restraining surface 168. Other roller assemblies may be provided along the length of cap 134 to facilitate easy movement of span 16 thereabove. Motivator 140 is similar to the motivator 74 described with respect to FIG. 2 and therefore will not be described here in detail. Suffice it to say that a gear 170 extends from the motivator 140 and includes vertically aligned teeth that open, at least to one side, facing an edge 172 of lower structure 136.

Lower structure 136 includes a top surface 173 for supporting upper structure 138 and a bottom surface 175. Bottom surface 175 forms a plurality of recesses (e.g., 174, 176) that are sized and positioned so as to receive upward facing rollers that are mounted within cap 134. Thus, recess 174 forms a load bearing surface 180 that receives support surface 160 while recess 176 forms a load bearing surface 182 that receives support surface 156. An upper portion of edge 172 contacts guidance surface 164 to restrain lateral movement of span 16. Upper surface 173 forms an upward facing restraining surface 188 that contacts downward facing restraining surface 168.

Upper structure 138 includes a plurality of I beams 190 that support a concrete road surface 192 thereabove. A guide rail 194 is provided along a lateral edge of member 192. Referring also to FIG. 2, configuration of upper structures 106 and 138 is relatively unimportant with respect to what is believed to be novel and therefore are not explained here in detail. Suffice it to say structures 106 and 138 must be rigid and must be securely mounted to the top surfaces of lower structures 104 and 136, respectively.

Figure 3:
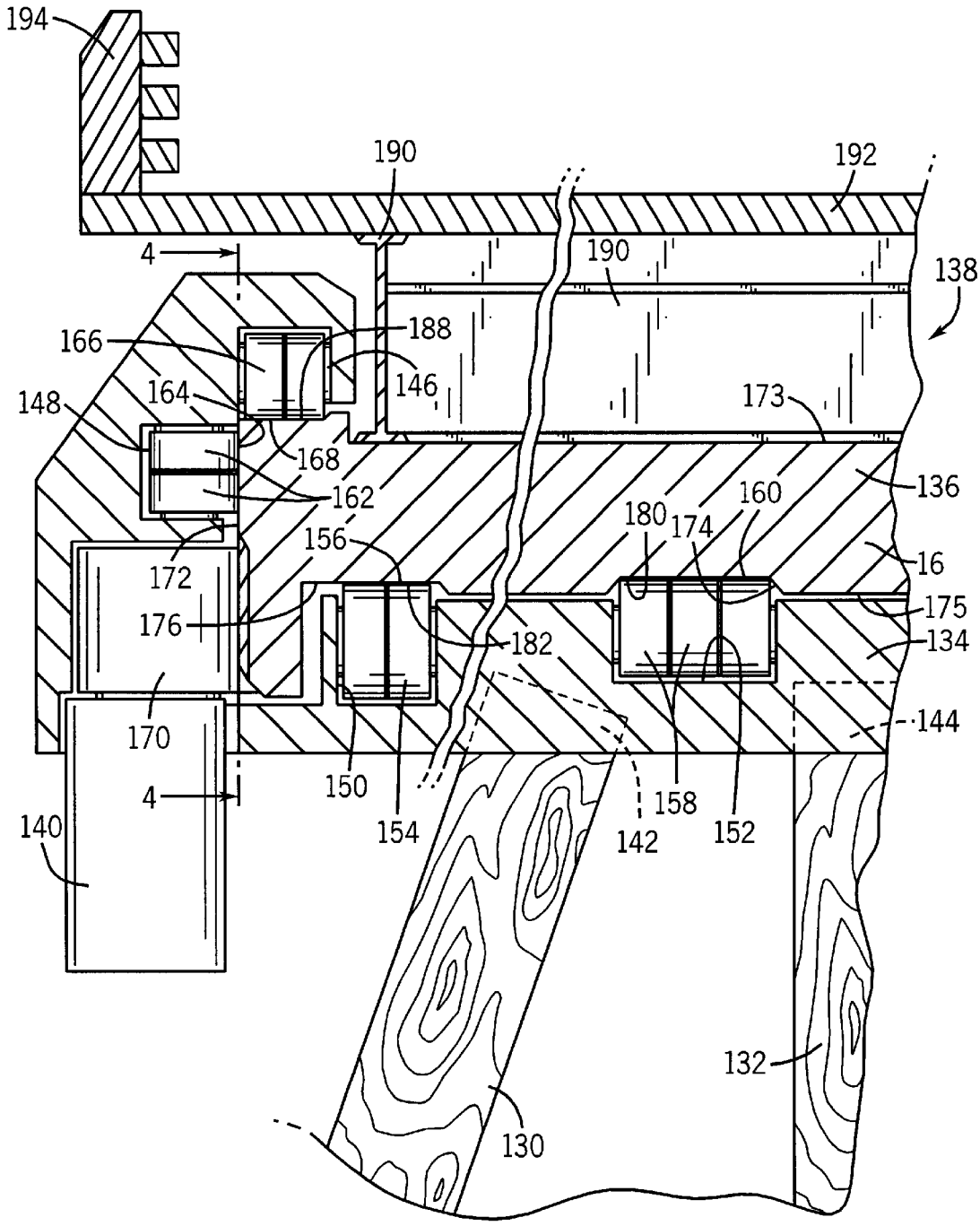
FIG. 3 is a cross-sectional view taken along the line 3—3 of FIG. 1*b;*

As in the case of the roller system illustrated in FIG. 2, the system illustrated in FIG. 3 is only exemplary and a plurality of roller systems like the one illustrated in FIG. 3 would likely be provided at various locations along the tops of piers 14, 16 and 18.

Figure 4:
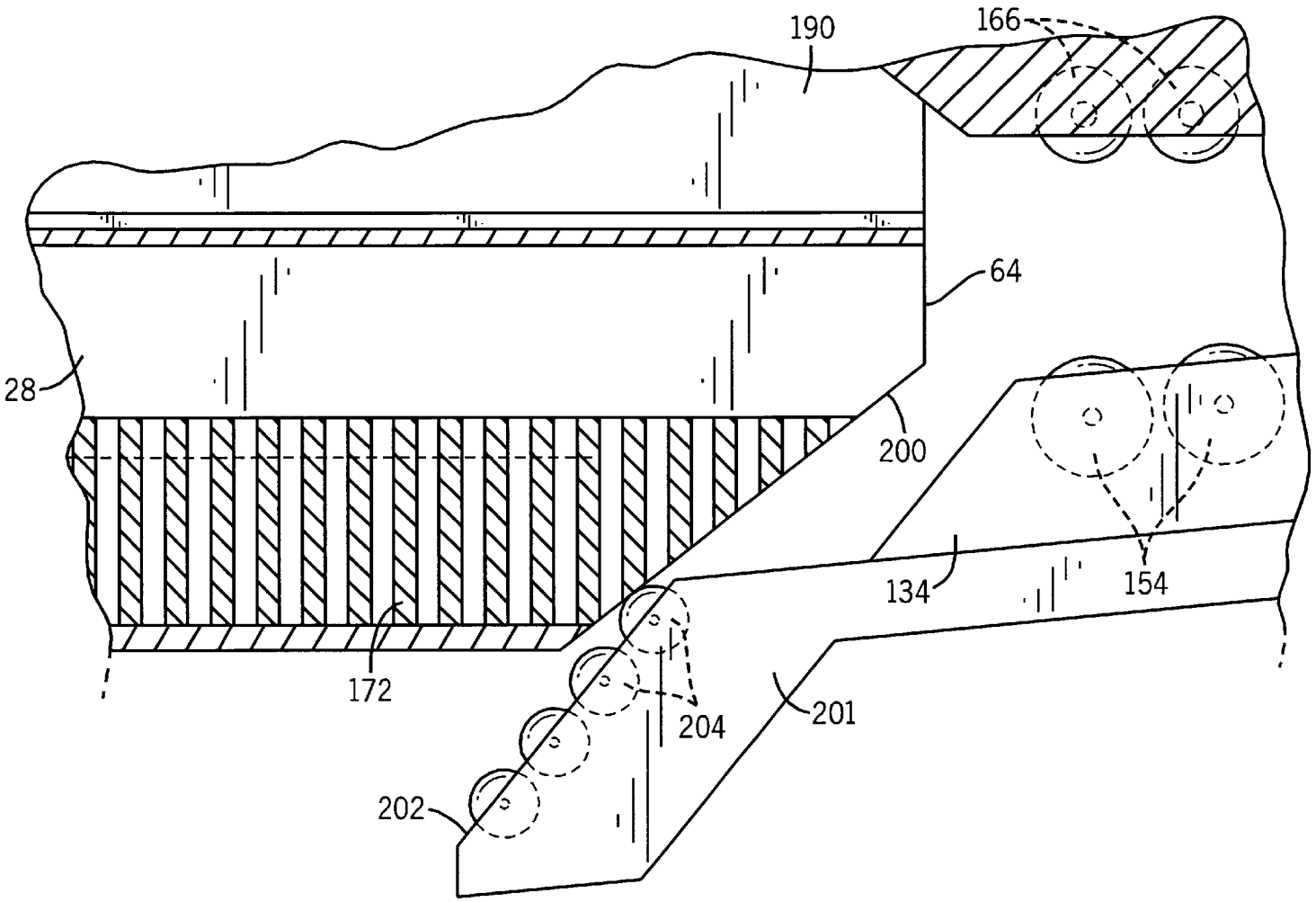
FIG. 4 is a schematic view taken along the line 4—4 of FIG. 3.

Referring now to FIGS. 1*a* through 1*d* and also to FIG. 4, while span 28 is to be constructed of concrete and steel and other types of rigid materials and therefore should be extremely rigid, where the open space 58 is relatively large (e.g., 60–100 feet), while span 28 is being moved from its open position to the position where space 58 is closed, leading edge 64 may bow downward a small distance when span 28 is at its most extended point and just prior to support by pier 18. For this reason, in an advantageous embodiment, a guiding mechanism is provided at the receiving edge of pier 18 for "lifting" the leading edge 64. To this end, the underside 200 of leading edge 64 is sloped so that underside 200 can be used to guide span 28 upward when edge 64 reaches pier 18. In addition, a guiding component 201 is attached to the bottom of cap 134. Guiding component 201 extends longitudinally from the under surface of cap 134 and includes a sloped surface 202 that is effectively a mirror image of sloped surface 200. In addition, a plurality of rollers 204 are provided on sloped surface 202 to reduce friction between surfaces 200 and 202 during reception of span 28.

Figure 5A:
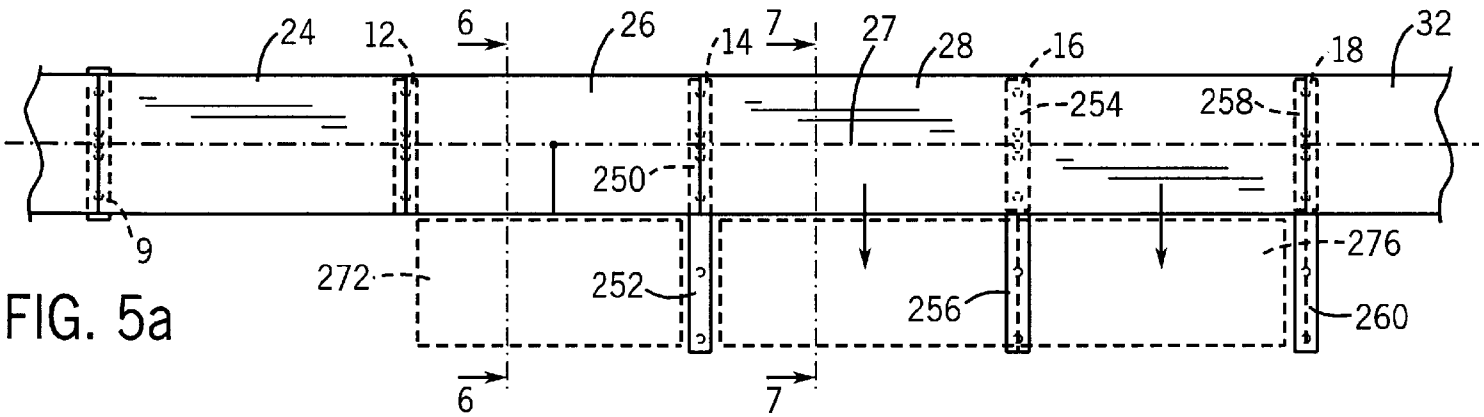
FIGS. 5*a* through 5*c* are schematic views of a second embodiment of the present invention.
Figure 5B:
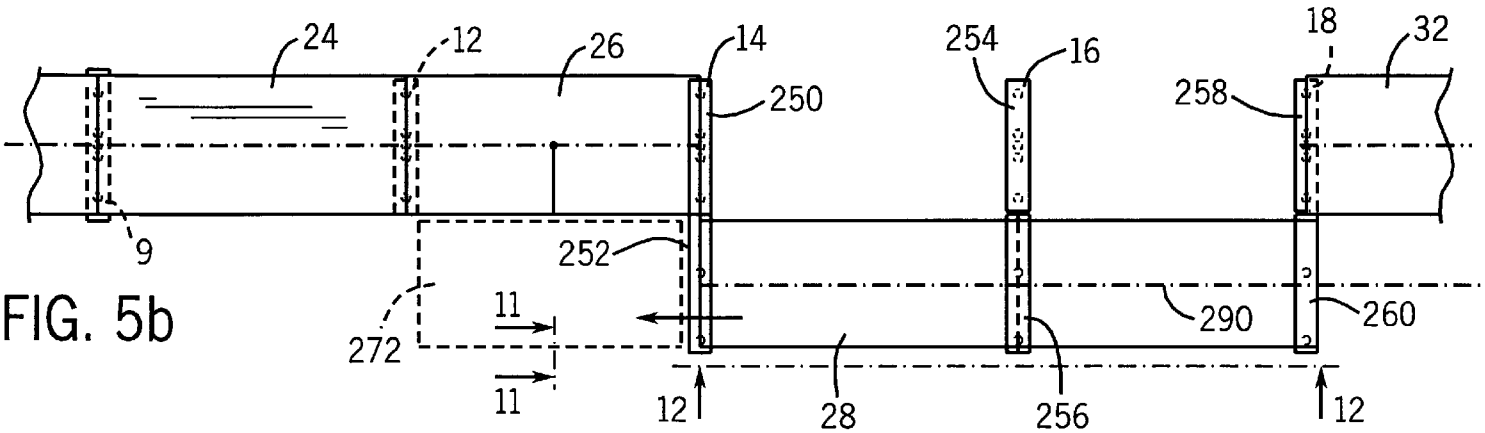
Figure 5C:
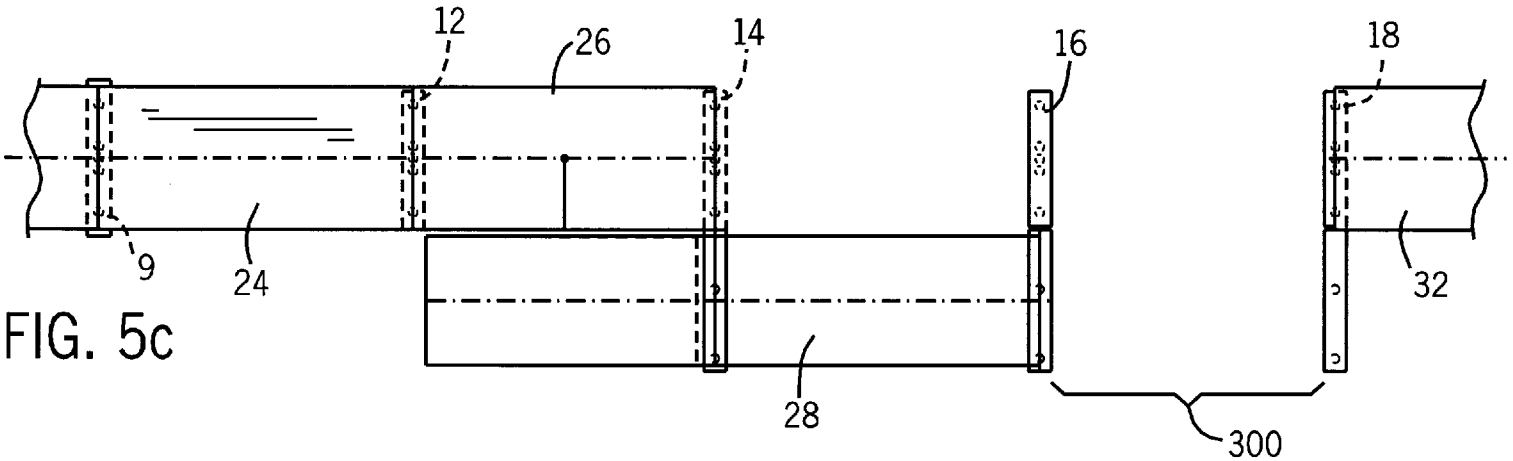

Referring now to FIGS. 5*a* through 5*c,* a second embodiment of the invention is illustrated. This second embodiment, like the first embodiment, includes a plurality of piers 9, 12, 14, 16 and 18 and a plurality of spans 24, 26, 28 and 32 that traverse the distance between the piers. Each of piers 9 and 12 have a width that is generally the same width as each of the spans (e.g., 24). Each of piers 14, 16 and 18, however, has a width that is approximately twice as wide as the width of any of the spans (e.g., 28). To this end, pier 14 includes an in-line section 250 that is in-line with piers 9 and 12 and a lateral section 252 that is laterally positioned with respect to in-line section 250. Similarly, pier 16 includes an in-line section 254 and a lateral section 256 while pier 18 includes an in-line section 258 and a lateral section 260.

Referring now to FIGS. 1*a* and 5*a* through 5*c,* as above, in order to understand the second embodiment, it is advantageous to define specific piers by specific names and specific spaces with respect to those piers by specific names. To this end, piers 12, 14 and 18 are referred to generally as first, second and third piers, while pier 16 is referred to as an intermediate pier. In FIG. 1*a,* the space between piers 12 and 14 is referred to as a first in-line space, the space 50 between piers 14 and 18 is referred to as a second in-line space, the space above first in-line space 48 is referred to as a third in-line space 52 and the space 54 above second in-line space 50 is referred to as a fourth in-line space 54. The in-line spaces are aligned along a longitudinal axis 27.

In addition, referring to FIGS. 1*a,* 5*a* and 6, the space that is adjacent each of first in-line space 48 and lateral pier section 252 is referred to as a first lateral space 270 and the space above first lateral space 270 is referred to as a third lateral space 272. Referring to FIGS. 1*a,* 5*a* and 7, the space between lateral pier sections 252 and 260 is referred to as second lateral space 274, the space thereabove is referred to as fourth lateral space 276, the space between intermediate pier 256 and lateral section 260 is referred to as a fifth space and the space above the fifth space is referred to as an openable space. The lateral spaces are aligned along a lateral axis 290.

Figure 7:
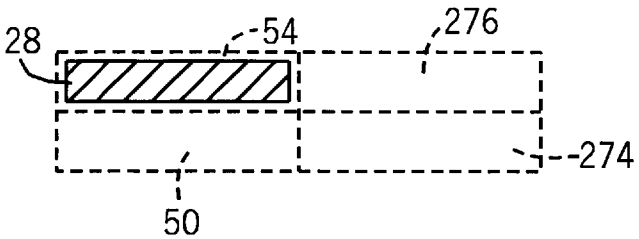
FIG. 7 is a schematic cross-sectional view taken along the line 7—7 of FIG. 5*a;*
Figure 6:
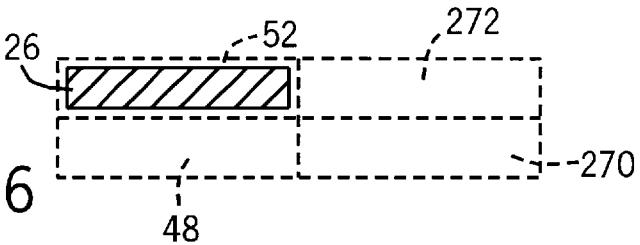
FIG. 6 is a schematic cross-sectional view taken along the line 6—6 of FIG. 5*a;*

With the piers and spaces defined above, operation of the bridge illustrated in FIGS. 5*a* through 5*c* can be easily understood. Referring still to FIGS. 5*a* through 5*c* and also to FIGS. 6 and 7, initially, to facilitate vehicular traffic over the bridge, second span 28 is in the fourth in-line space 54 (see FIG. 7). To open the bridge and allow water bound traffic to pass therethrough, first, span 28 is moved from the fourth in-line space 54 laterally to the fourth lateral space 276 so that span 28 is supported on the tops of lateral sections 252, 256 and 260 of piers 14, 16 and 18 as illustrated in FIG. 5*b*. Next, span 28 is moved longitudinally along the lateral axis 290 to the left as illustrated in FIG. 5*b* until a segment (i.e., the lefthand half of span 28 referred to as the "openable space" above) is positioned within third lateral space 272 as illustrated in FIG. 5*c*. After this second move, an open space 300 is formed between piers 16 and 18 to allow water bound traffic to pass therethrough unobstructed.

To reclose the bridge, the process as described above is reversed. To this end, span 28 is first moved to the right as illustrated in FIG. 5*c* until the entire span 28 is within fourth lateral space 276. Then span 28 is moved laterally back into space 54 above the in-line sections of piers 14, 16 and 18.

The movement systems used in the second embodiment would be similar to those used in the first embodiment including motivators, roller assemblies and tracks, and should be configurable by one of ordinary still in the art. Nevertheless, it should be appreciated that while this embodiment is contemplated, in some ways, this embodiment is less preferred than the first embodiment because the movement system mechanics would be more complex. This is because the movement mechanics have to facilitate movement of span 28 in two separate directions (i.e., laterally and then longitudinally). In addition to the motivators for span movement laterally and longitudinally, this design would also likely require some other moveable components.

Referring now to FIGS. 5*a,* 11 and 12, exemplary movement assemblies at the tops of piers 14 and 18 are illustrated. Specifically, the assemblies illustrated are located at the tops of lateral pier sections 252 and 260. Pier 14 includes timbers 450 and 452, a pier cap 454, several lateral roller assemblies 456 (only one illustrated), a hydraulic lift 451 for each lateral roller assembly, a span assembly 28 and at least two longitudinal roller assemblies 458 and 460. From the first embodiment description above the functions, configurations and operation of most of the components of FIGS. 11 and 12 should be understood and therefore will not be explained again here in detail.

Hydraulic lift 451 is mounted on a top surface of cap 454 and includes an upwardly extending shaft 462. Roller assembly 456 is mounted at the top end of shaft 462. Lift 451 is capable of changing the vertical elevation of roller assembly 456 and other span components (e.g., 28) thereabove.

Figure 13:
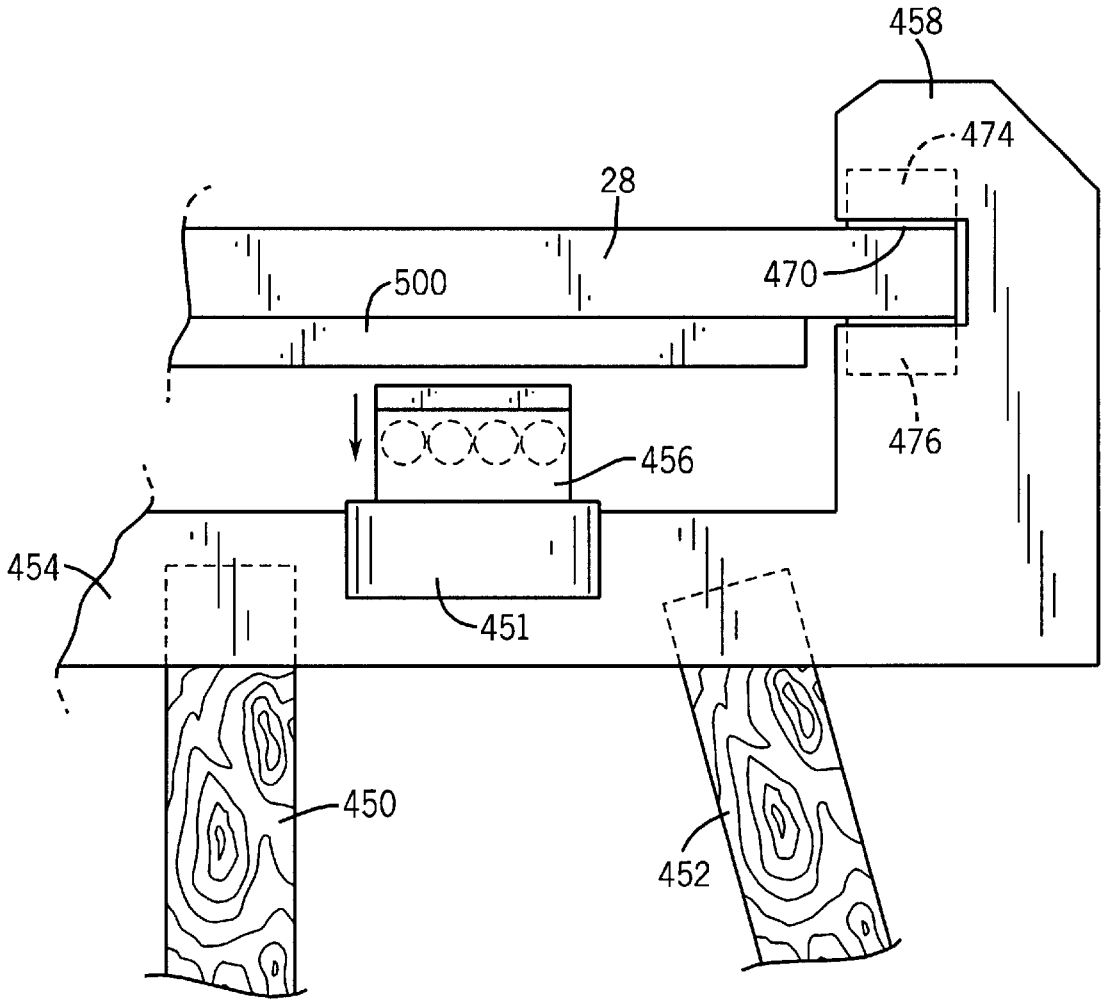
FIG. 13 is a view similar to FIG. 11, albeit with a bridge span in a different position and retracted lifts.

Referring to FIGS. 5*a,* 11, 12 and 2, the lateral roller assemblies at the tops of in-line pier sections 250, 254 and 258 need not include hydraulic lifts (e.g., 451) and therefore are more akin to the assemblies illustrated in FIG. 2. In their highest position (i.e., with corresponding hydraulic lifts 451 extended to a maximum point), the rollers of assemblies 451 would be at the same vertical height as, and would be aligned with, the stationary roller assemblies on the in-line pier sections 250, 254 and 258. Thus, at their lowest position (i.e., with lifts 451 retracted), the rollers of assemblies 451 would be below the stationary rollers at a lowest level (see also FIGS. 13 and 14).

Referring again to FIGS. 11 and 12, longitudinal roller assembly 458 extends up from cap 454 at a lateral end of cap 454 and forms a receiving bay 470 designed to receive a lateral edge 472 of span 28. To this end upper and lower roller banks 474 and 476, respectively, are provided in bay 470 for supporting edge 472. The space D1 between roller banks 474 and 476 is slightly greater than the width D2 of end 472. The second longitudinal roller assembly 460 includes a single upward facing roller bank 461 on a side of hydraulic lift 451 opposite assembly 458. Importantly, as best seen in FIG. 12, cap 454 extends longitudinally past an adjacent end 449 of span 28 on a side of lift 451 opposite pier 18.

Figure 12:
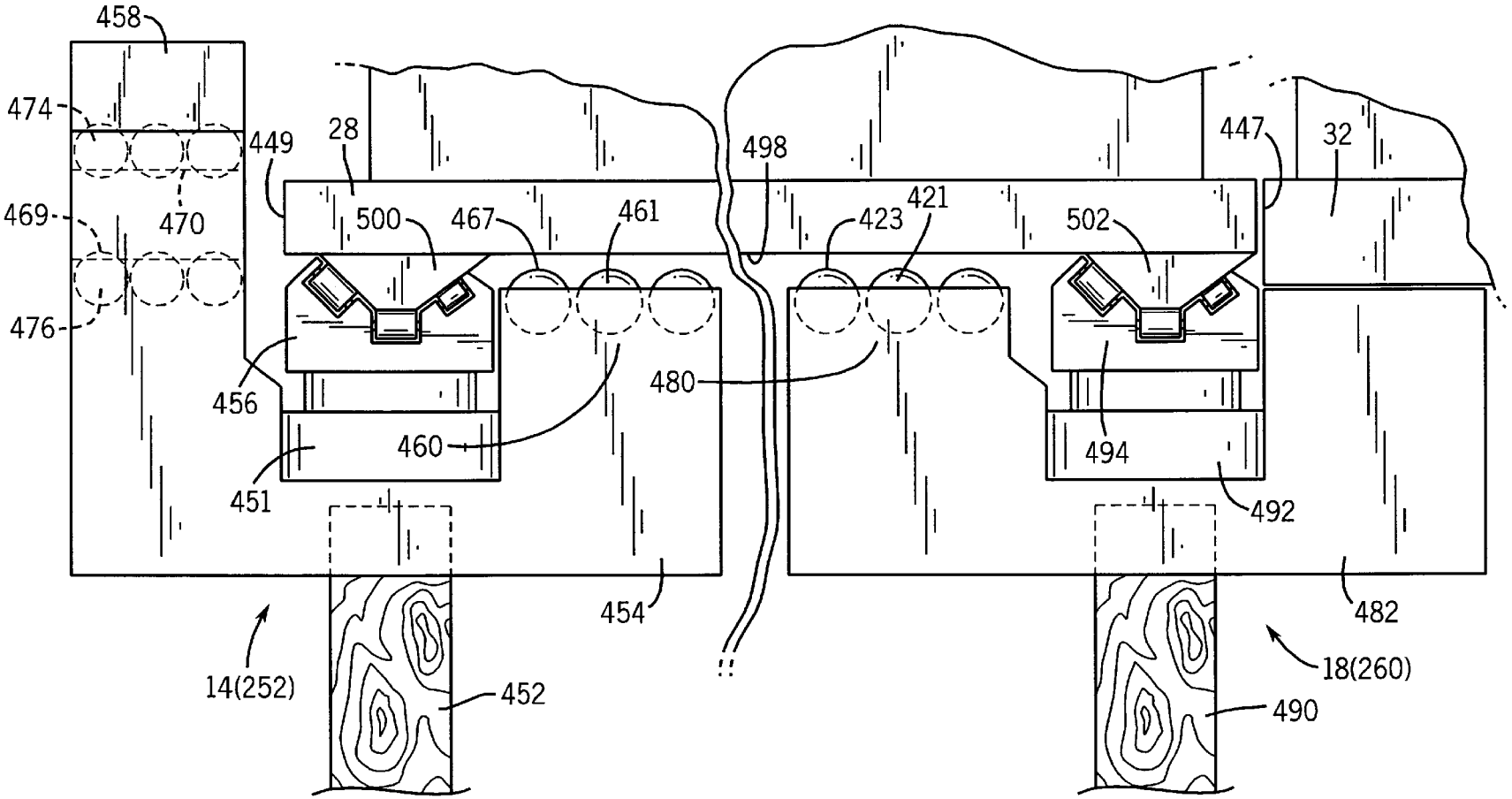
FIG. 12 is a plan view of the assembly of FIG. 5*b* taken along the line 12—12.
Figure 14:
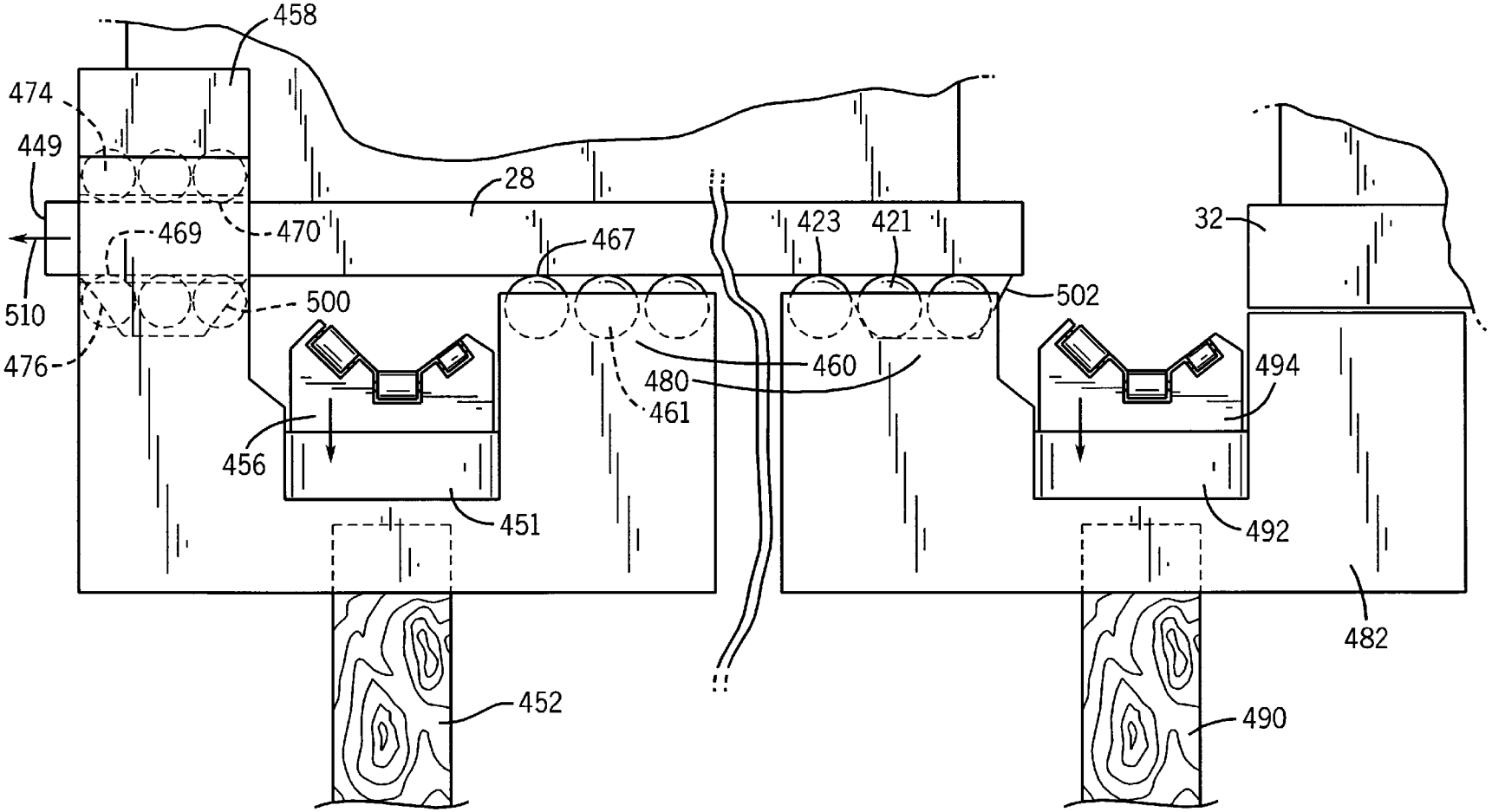
FIG. 14 is a view similar to FIG. 12, albeit with a bridge span in a different position and retracted lifts.

Referring to FIGS. 12 and 14, upward facing roller banks 461 and 476 are at the same vertical height which is slightly higher than the top of roller assemblies 451 when those assemblies 451 are in their lower positions.

Referring to FIGS. 5*a* and 12, the components at the top of lateral pier section 260 are similar to the components at the top of section 252 with a few exceptions. Similarities include a supporting timber 490, a pier cap 482, a hydraulic lift 492 and several (only one shown) lateral roller assemblies 494. A first distinction is that only a single roller assembly 480 is provided at the top of pier cap 482 on the same side of lift 492 as pier 14. Assembly 480 includes a roller bank 421 that defines an upward facing support surface 423. The height of surface 423 is identical to the heights of surfaces 460 and 467 and is slightly higher than the tops of assemblies 494 when assemblies 494 are in their lowest positions. On the side of lift 492 opposite roller assembly 480, span 32 rests on, and is securely mounted to, the top of pier 18.

Figure 11:
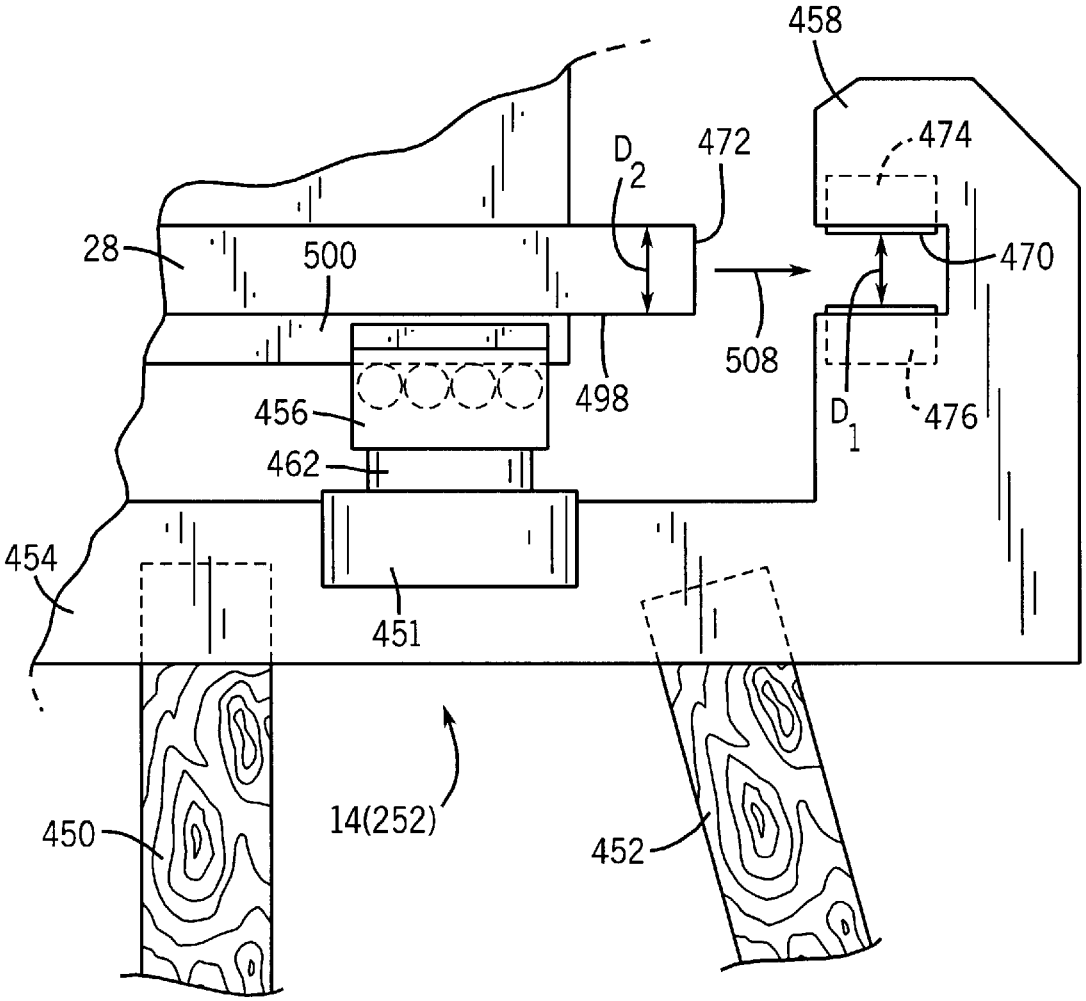
FIG. 11 is a plan view of the assembly of FIG. 5*b* taken along the line 11—11.

Referring still to FIGS. 11 and 12, span 26 forms an under surface 498 that defines downwardly extending track members 500 and 502. Each track member 500, 502 is shaped so as to be received and supported by roller assemblies 451 and 494 there below and thus extend laterally across span 28. Track members 500 and 502 do not extend completely across span 28, but rather stop short of end 472. This is so that end 472 can be received within bay 470.

In operation, to open the bridge, referring to FIGS. 11 through 14, with span 28 in the in-line position (see FIG. 5*a*) and lifts 451 and 492 extended, a motivator (not illustrated), drives span 28 laterally in direction 508 on roller assemblies 456 and 494 into a position supported above lateral pier sections 252, 256 and 268. An intermediate span position is illustrated in FIG. 11. The motivator continues to drive span 28 until end 472 is aligned with but longitudinally displaced from bay 470 as illustrated in FIGS. 5*b* and 12. Next, lifts 451 and 492 are lowered. When lifts 451 and 492 are lowered, span 28 comes to rest and be supported on the upward facing roller bank surfaces 467 and 423. Span 28 supported by roller assemblies 461 and 421 is illustrated in FIG. 14. Note that lifts 451 and 492 need only be lowered a very small amount and therefore span 28 is only lowered very slightly.

Continuing, referring to FIG. 14, the second motivator (not illustrated) drives span 28 longitudinally in the direction indicated by arrow 510. As span 28 is driven longitudinally, end 449 is received within bay 470 and is supported and restrained by roller assemblies 474 and 476. Referring specifically to FIG. 14, roller assembly 458 should be positioned relative to assembly 480 such that span end 449 is fully received between banks 474 and 476 prior to opposite span end 447 coming off roller bank 421. This ensures that end 447 will be supported in a cantilevered manner upon becoming unsupported.

The second motivator continues to drive span 28 in the direction of arrow 510 until span 28 is in the position illustrated in FIG. 5*c* where space 300 is completely open for river bound travel.

To close space 300 and facilitate vehicular travel, span 28 is driven from its location in FIG. 5*c* to the location in FIG. 5*b* while being supported on longitudinal roller assemblies 458, 460, 480, etc. Next, lifts 451 and 492 are extended to lift span 28 up and above longitudinal assemblies 460 and 480 and so that span 28 is supported by lateral assemblies 456 and 494. Continuing span 28 is driven from the position in FIG. 5*b* to the position in FIG. 5*a*.

Importantly, when span 28 is in the in-line position (see FIG. 5*a*), span 28 is fully supported by rigid mechanical rollers as opposed to hydraulic lifts. This makes for a more resilient bridge system.

Figure 8A:
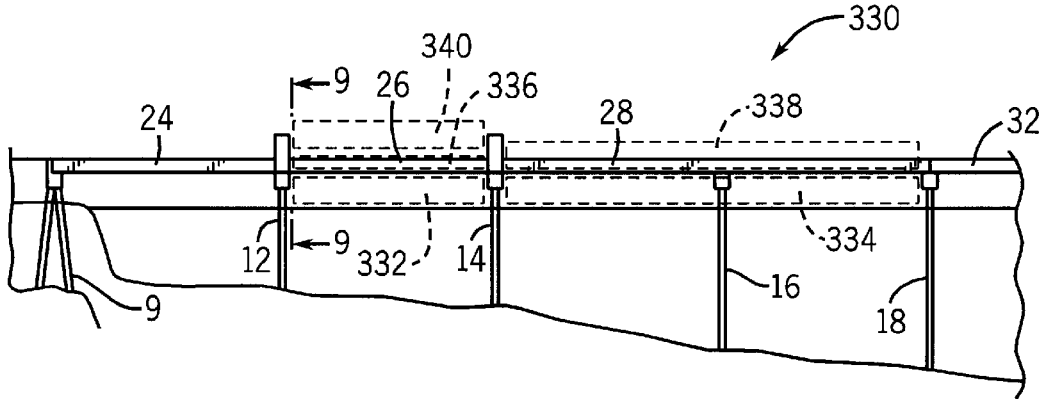
FIGS. 8*a* through 8*c* are schematic diagrams illustrating a third embodiment of the present invention.
Figure 8B:
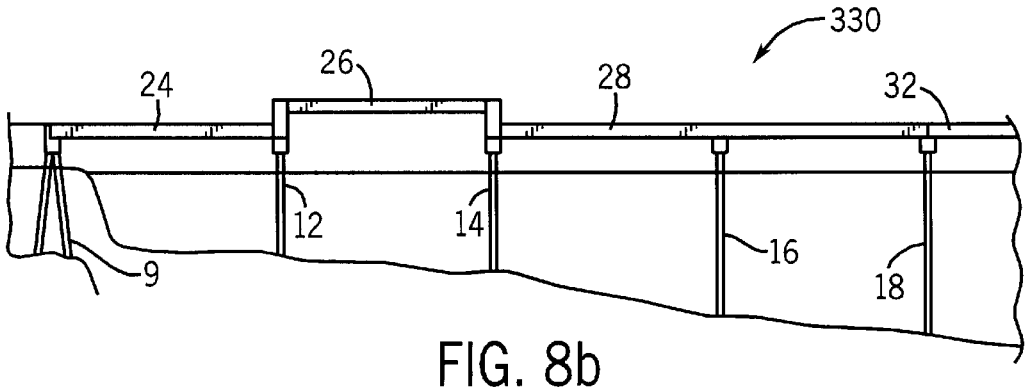
Figure 8C:
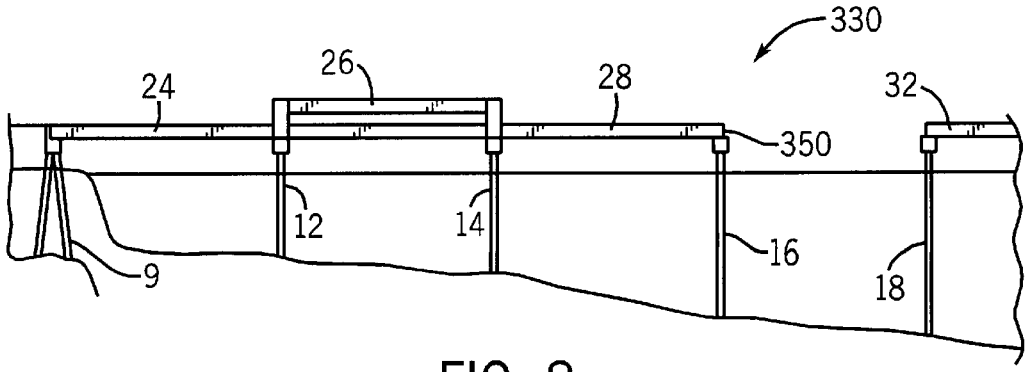

Referring now to FIGS. 8*a* through 8*c,* a third embodiment of the present invention will be described in the context of a bridge 330 that includes a plurality of piers 9,12, 14, 16 and 18. In addition, bridge 330 includes spans 24, 26, 28 and 32 that traversing a distances between the piers, each of spans 24, 26 and 32 traversing a distance between adjacent piers and span 28 being approximately twice as long as the other spans, traversing a distance between piers 14, 16 and 18.

To understand this third embodiment, as with the embodiments described above, it is helpful to specifically label several of the piers and the spaces relative thereto. To this end, piers 12, 14 and 18 are referred to as first, second and third piers, respectively, pier 16 is referred to as an intermediate pier, the space between piers 12 and 14 is referred to as a first space 333, the space between piers 14 and 18 is referred to as a second space, the space above the first space is referred to as a third space 336, and the space above second space 334 is referred to as a fourth space 338. Third space 336 is approximately the same size as span 26 and the space thereabove is referred to as a fifth space 340.

In operation, to open a section of bridge 330, first, with span 26 supported between piers 12 and 14 and within third space 336, first span 26 is raised up and into fifth space 340 thereabove. After this move, the bridge is in the configuration illustrated in FIG. 8*b*. Next, span 28 is moved from fourth space 338 toward third space 336 such that a segment [e.g., approximately the left half of span 28 as illustrated] of span 28 moves into third space 336. After this move, bridge 330 is configured as illustrated in FIG. 8*c* with a leading end 350 of second span 28 supported on the top of pier 16. In this configuration, the space between and above piers 16 and 18 is completely unobstructed and water bound traffic can pass there through.

To reclose bridge 300, the method described above is simply reversed. To this end, span 28 is moved toward span 32 until leading end 350 contacts and is supported by the top of span 18. This configuration is illustrated FIG. 8*b*. Next, span 26 is lowered until that span is supported on the tops of piers 12 and 14 as illustrated in FIG. 8*a*.

Figure 9:
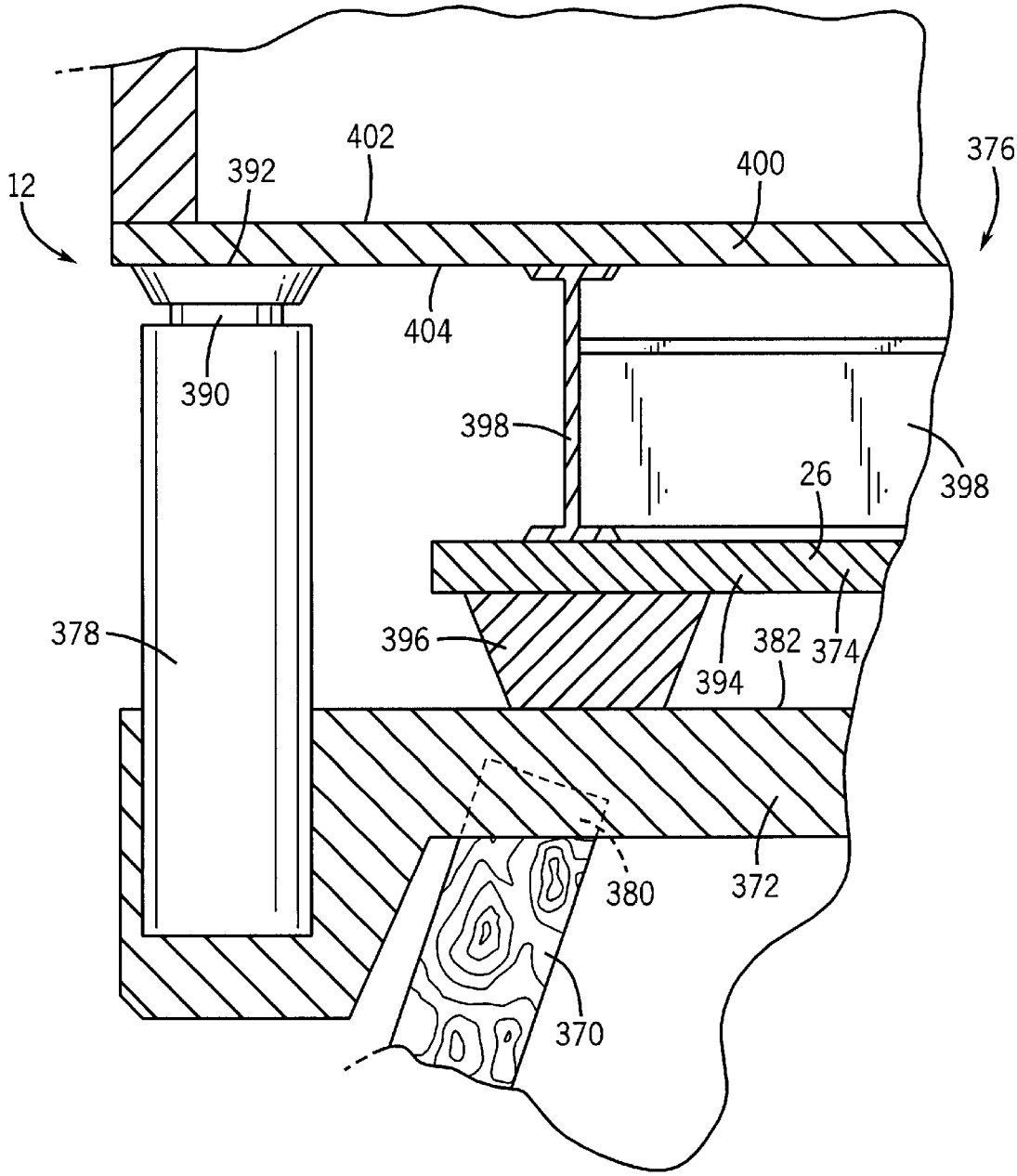
FIG. 9 is a cross-sectional view taken along the line 9—9 of FIG. 8*a;*

Referring now to FIGS. 8*a* and 9, in order to raise and lower span 26, the components illustrated in FIG. 9 are provided at each end at each of piers 12 and 14. Because the components at each end of each of piers 12 and 14 are generally the same, only the components provided at one end of pier 12 are illustrated. The components at pier 12 include a timber 370, a lower construct 374, an upper construct 376 and a motivator 378. Timber 370 has a lower end (not illustrated) that extends down to the bottom of the river and an upper end 380 that is received by and supports cap 372. As above, other timbers would also be provided to support cap 372. Cap 372 forms an upper surface 382 that is essentially flat. Motivator 378 is mounted to cap 372 in any manner known in the art. Motivator 378 is simply a lifting mechanism including a hydraulic motor of some type and a shaft 390 that extends upwardly therefrom. A distall end 392 of shaft 390 can be raised and lowered in a manner explained in more detail below.

Referring still to FIG. 9, lower structure 374 includes a concrete base member 394 and a stopper member 396 that extends downward therefrom. One or more other stopper members 396 (not illustrated) would be provided along the length of member 394 to support that member above surface 382.

Upper structure 376 includes a plurality of eye beams 398 that form a lattice and support a deck 400 thereabove. Deck 400 forms top and bottom surfaces 402 and 404, respectively. The lattice formed by beams 398 contact under surface 404. In addition, distall end 392 of shaft 390 contacts under surface 404. Surface 402 provides a driving deck for vehicular traffic.

Figure 10:
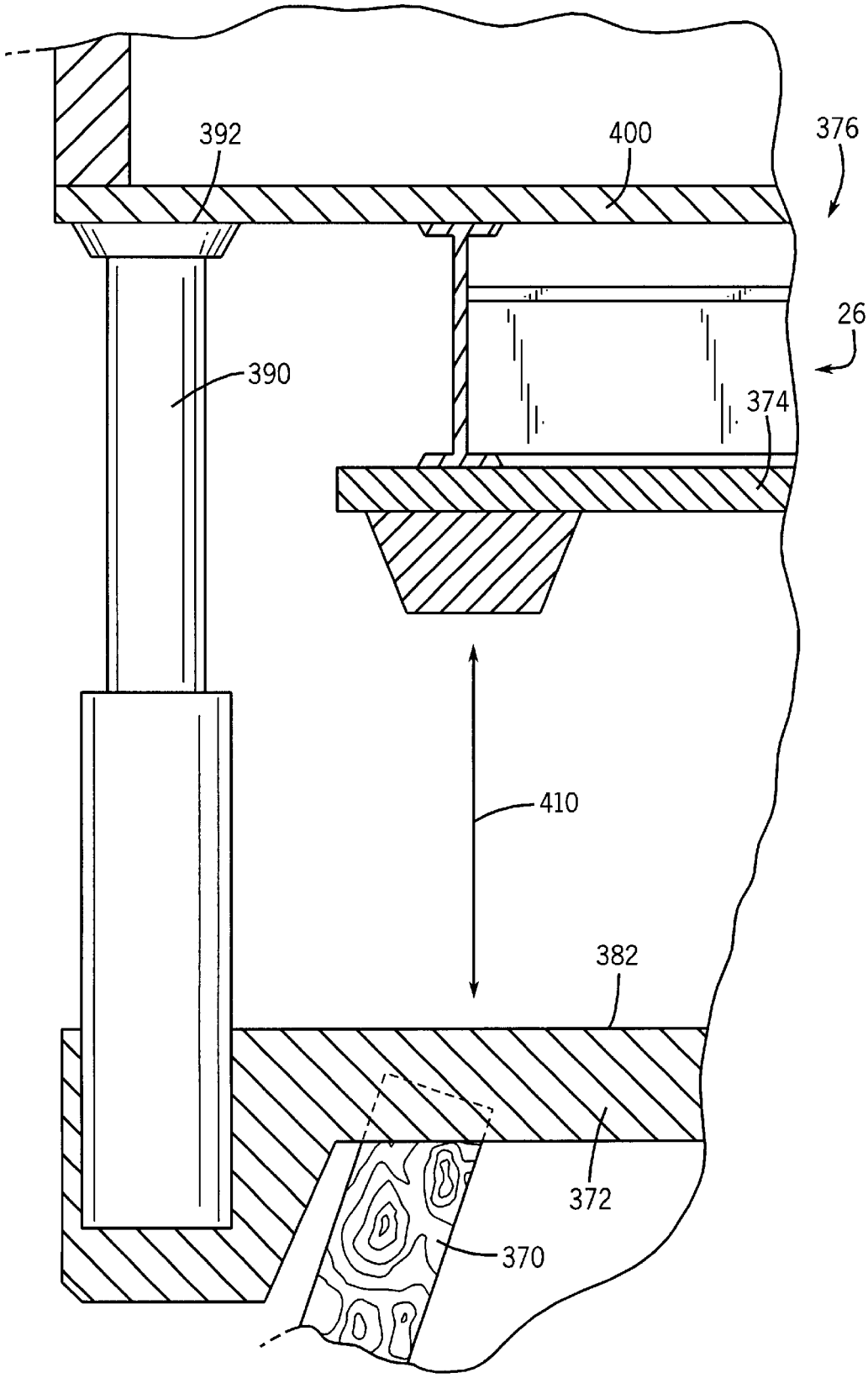
FIG. 10 is similar to FIG. 9, albeit illustrating an extended shaft and a raised span.

Referring now to FIGS. 9 and 10, the components of FIG. 9 are shown in FIG. 10 in a raised position where shaft 390 has been extended to raise both the upper and lower structures 376 and 374, respectively. Once raised, a space 410 is provided between span 26 and surface 382. Referring also to FIG. 8*b* and FIG. 8*c*, once span 26 is raised as illustrated in FIG. 10, span 28 is rolled into space 410. The support rolling structure used to roll span 28 is similar to the structure illustrated in FIG. 3.

It should be understood that the methods and apparatuses described above are only exemplary and do not limit the scope of the invention, and that various modifications could be made by those skilled in the art that would fall under the scope of the invention. For example, while the embodiments above include roller assemblies mounted to the tops of piers, other embodiments may include roller assemblies mounted to the undersides of spans. In addition, referring to FIGS. 8*a*–8*c*, instead of moving span 26 upward, span 26 may be lowered to provide a space for span 28. Moreover, referring to FIGS. 5*a*–5*c* and 11 through 14, while that embodiment shows span 28 being vertically repositioned between lateral and longitudinal moves, in other embodiments rollers may be raised and lowered so that the vertical span position remains essentially constant. Furthermore, while two motivators are described above, it should be appreciated that some embodiments may require only a single motivator. In addition, embodiments with additional vertical restraints are contemplated.

To apprise the public of the scope of this invention, the following claims are made:

What is claimed is:

1. A bridge assembly comprising:

first, second and third adjacent piers, the first and second piers defining a first space there between and the second and third piers defining a second space there between, third and fourth spaces above the first and second spaces, respectively;

a first bridge span positionable so as to traverse the distance between the first and second piers within the third space and translationally mounted to at least one of said first and second piers;

a second bridge span positionable so as to traverse the distance between the second and third piers within the fourth space and translationally mounted to said second piers;

a first motivator linked to the first bridge span for moving the first span into and out of the third space; and a second motivator linked to the second bridge span for moving at least a portion of the second bridge span from the fourth space to the third space so that at least a portion of the fourth space is unobstructed.

2. The assembly of claim 1 further including at least one intermediate pier between the second and third piers, the space between the intermediate and third piers being a fifth space, the space above the fifth space being an openable space, the openable space being the portion of the fourth space that is unobstructed when the portion of the second bridge span is moved to the third space.

3. The assembly of claim 2 wherein the first, second, third and intermediate piers are essentially equi-spaced.

4. The assembly of claim 2 further including roller members between the tops of the piers and the spans thereabove.

5. The assembly of claim 4 wherein the rollers are mounted to the tops of the piers.

6. The assembly of claim 1 wherein the first span has a span width, each of the first and second piers has a pier width that is substantially twice as wide as the span width, first and second in-line sections of the first and second piers, respectively, aligned with the third pier and defining an in-line space, a supporting space above the in-line space, first and second lateral sections of the first and second piers laterally adjacent the first and second in-line sections, respectively, the lateral sections defining a lateral space there between, a receiving space above the lateral space, the first motivator for moving the first span between the supporting space and the receiving space.

7. The assembly of claim 6 further including rollers between the spans and the tops of the piers.

8. The assembly of claim 7 wherein the rollers are mounted to the tops of the piers.

9. The assembly of claim 6 wherein the first and second in-line sections and first and second lateral sections comprise one lateral load bearing element and the first span comprises another lateral load bearing element and the assembly further includes a first track mounted to a first one of the lateral load bearing elements and rollers mounted to the second of the lateral load bearing elements, the rollers supportable on the track to facilitate rolling of the first span between the supporting and receiving spaces.

10. The assembly of claim 9 wherein the track is secured to the first span and the rollers are secured to the tops of the piers.

11. The assembly of claim 9 further including an intermediate pier between the second and third piers and wherein the second and intermediate piers comprise a longitudinal load bearing element and the second span comprises another longitudinal load bearing element and, wherein, the assembly further includes a second track mounted to a first one of the longitudinal load bearing elements and rollers mounted to the second of the longitudinal load bearing elements, the rollers supportable on the track to facilitate rolling of the second span such that the at least one section moves between the fourth space and the supporting space.

12. The assembly of claim 11 wherein the longitudinal load bearing element that includes the second and fourth piers also includes the first pier.

13. The assembly of claim 1 wherein the first motivator moves the first span between the third space and a space above the third space.

14. The assembly of claim 1 wherein the first motivator moves the first span between the third space and the first space.

15. The assembly of claim 1 wherein the second span includes first and second ends, a top and a bottom, the second end adjacent the third pier when the second span is in the fourth space, the assembly further including first and second aligning apparatus at the second end and the top of the third pier, respectively, the second aligning apparatus receiving the first aligning apparatus when the second span is moved into the fourth space so as to align the second span with the third pier.

16. The assembly of claim 15 wherein the first aligning apparatus includes a first inclined surface.

17. The assembly of claim 16 wherein the second aligning apparatus includes a second inclined surface.

18. The assembly of claim 16 wherein the second aligning apparatus includes a guiding roller.

19. A bridge assembly comprising:

first, second and third adjacent piers, each of the second and third piers including an in-line section and an adjacent lateral section, the in-line sections aligned along a longitudinal axis and the lateral sections aligned along a lateral axis that is essentially parallel to the longitudinal axis, the first pier and second pier in-line section defining a first in-line space there between, the second and third pier in-line sections defining a second in-line space there between, a space adjacent the first in-line space and the second lateral section defining a first lateral space, the second and third lateral sections defining a second lateral space there between, third and fourth in-line spaces above the first and second in-line spaces, respectively, and third and fourth lateral spaces above the first and second lateral spaces, respectively;

a first bridge span positioned so as to traverse the distance between the first and second piers within the third in-line space;

a second bridge span positionable so as to traverse the distance between the second and third piers within the fourth space in-line and translationally mounted to said second pier;

a first motivator linked to the second bridge span for moving the second span between the fourth in-line space and the fourth lateral space; and a second motivator linked to the second bridge span for moving at least a portion of the second bridge span from the fourth lateral space to the third lateral space so that at least a portion of the fourth lateral space is unobstructed.

20. The assembly of claim 19 further including at least one intermediate pier between the second and third lateral pier sections, the space between the intermediate and third lateral section being a fifth space, the space above the fifth space being an openable space, the openable space being the portion of the fourth lateral space that is unobstructed when the portion of the second bridge span is moved to the third lateral space.

21. The assembly of claim 20 wherein the first lateral section, second lateral section, third lateral section and intermediate pier are essentially equi-spaced.

* * * * *

UNITED STATES PATENT AND TRADEMARK OFFICE

CERTIFICATE OF CORRECTION

PATENT NO. : 6,568,019 B2
DATED : May 27, 2003
INVENTOR(S) : Paul H. Markelz

It is certified that error appears in the above-identified patent and that said Letters Patent is hereby corrected as shown below:

Column 14,
Line 37, “piers” should be -- pier --.

Column 16,
Line 27, “space in-line” should be -- inline space --.

Signed and Sealed this

Twenty-fifth Day of November, 2003

JAMES E. ROGAN
*Director of the United States Patent and Trademark Office*